US006328410B1

(12) United States Patent
Kawase et al.

(10) Patent No.: US 6,328,410 B1
(45) **Date of Patent: *Dec. 11, 2001**

(54) PRINTER AND ITS CONTROL METHOD

(75) Inventors: Yuji Kawase, Matsumoto; Mitsuaki Teradaira, Shiojiri; Hidetake Mochizuki, Nagano-ken, all of (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/341,165

(22) PCT Filed: Nov. 2, 1998

(86) PCT No.: PCT/JP98/04963

§ 371 Date: Jul. 2, 1999

§ 102(e) Date: Jul. 2, 1999

(87) PCT Pub. No.: WO99/22941

PCT Pub. Date: May 14, 1999

(30) Foreign Application Priority Data

Nov. 5, 1997 (JP) ..... 9-302780

(51) Int. Cl.[7] ..... B41J 2/165
(52) U.S. Cl. ..... 347/23; 347/29
(58) Field of Search ..... 347/23, 29

(56) References Cited

U.S. PATENT DOCUMENTS

| | | | | |
|---|---|---|---|---|
| 5,379,061 | | 1/1995 | Yamaguchi et al. | 347/23 |
| 5,475,404 | * | 12/1995 | Takahashi et al. | 347/23 |
| 5,784,080 | | 7/1998 | Nitta et al. | 347/23 |

FOREIGN PATENT DOCUMENTS

| | | | | |
|---|---|---|---|---|
| 0 540 174 | * | 5/1993 | (EP) | 347/23 |
| 0 649 404 | | 1/1996 | (EP) . | |
| 3-234541 | | 10/1991 | (JP) . | |
| 4-27558 | | 1/1992 | (JP) . | |
| 8-142450 | | 6/1996 | (JP) . | |

* cited by examiner

*Primary Examiner*—N. Le
*Assistant Examiner*—Shih-Wen Hsieh
(74) *Attorney, Agent, or Firm*—Mark P. Watson

(57) ABSTRACT

In a printer 1, if a reset signal Vrst is supplied, an external reset signal V0 that can be recognized by software is supplied to a CPU 61. The CPU 61 stores the time when the signal V0 is recognized as a pause time into a nonvolatile RAM 62. Then, determination of whether or not the reset is intentional is performed based on a reset time interval which is sought from a plurality of the past reset times. If the reset is not intentional, an appropriate level of cleaning is instructed to an ink system 80; and if the reset is intentional, an initialization level of cleaning is instructed to the ink system 80.

40 Claims, 15 Drawing Sheets

PRINTER AND ITS CONTROL METHOD

BACKGROUND OF THE INVENTION

1. Technical Field

The present invention relates to a printing apparatus, and more specifically relates to a method for processing at the time of a reset and to a head cleaning processing method for an ink jet printing apparatus.

2. Background Art

An ink jet printing apparatus which ejects ink from an ink jet head for printing typically requires regular maintenance or cleaning processing to maintain reliability of the ink jet head; regular maintenance prevents problems such as clogged nozzles due to increased viscosity within the nozzles due to drying of ink, which results in defective printing.

Such cleaning processing is generally managed based on a timer, etc., according to the time elapsed from the last cleaning operation and the capped state of the ink jet head.

Also, if a printing apparatus which is controlled by a host computer is installed in a remote location from the host computer, as is the case for a POS printer or a network-printer, it is necessary to perfectly control the printer by remote-control. Accordingly, it has been required to execute similar initialization processing as the initialization processing at the time the printer is powered on in response to a reset signal from the host computer, and in cleaning operations, an initialization level of cleaning has been executed, consuming large quantities of ink.

The reset signal can be issued at various times, including when the host computer is turned on, when the OS (operating system) boots up, when an application boots up, and when an application starts printing. As a result, multiple reset signals can be sent to the printer at relatively short time intervals depending upon the host computer type, application, and printer driver, etc., (hereinafter, such a reset signal is referred to as an "unintentional reset signal").

In such a case, a conventional printer executes initialization level cleaning each time, this consumes more ink than is really necessary. This results in higher operating costs, decreasing the quantity of ink actually used, and is not desirable in terms of resource conservation and environmental protection, producing increased numbers of expended ink cartridges due to more frequent changes of ink cartridges.

Also, in order to maintain printer reliability, it has been impossible to totally ignore reset signals supplied from the outside since reset signals may be generated for a variety of reasons.

Accordingly, an object of the present invention is to provide a printing apparatus and cleaning processing method which allow reduction in the quantity of ink consumed by avoiding excessive cleaning while maintaining reliability of the printing apparatus.

DISCLOSURE OF INVENTION

Accordingly, the present invention takes into account the fact that in reset signals supplied to a printing apparatus, time intervals between supplied reset signals fall substantially within a predetermined range, if such a system configuration is determined as a model of the host computer, or applications operating on the host computer, etc., thus enabling determination of whether or not the reset signal supplied to the printing apparatus is intentional continuous reset (designed to execute an initialization level cleaning). Furthermore, in order to perform the determination by a control device such as a CPU, the reset signal is supplied in such a way that it is supplied not as a reset signal to forcibly initialize the control device by means of hardware, but as a reset signal to operate by means of software which can be recognized by the control device.

That is, the printing apparatus of the present invention is a printing apparatus which is operated based on data and control signals including reset signals from a host computer, characterized by comprising a time measuring means for measuring receiving time intervals between reset signals, a nonvolatile memory means for storing reset signal receiving intervals as reset time intervals, a control means for controlling operation of the printing apparatus including writing and reading of information into and out of the memory means, and a reset signal processing means for providing the control means with external reset signals which indicate receipt of reset signals, the control means setting a predetermined range based on a plurality of reset time intervals stored in the nonvolatile memory means for determining whether or not the nearest reset time interval falls within the predetermined range.

According to the present invention, the control device is not reset by means of hardware, even if a reset signal is supplied, so that the time interval with which the reset signal is supplied can be stored in a memory. Accordingly, it is possible to determine whether or not the reset signal is intentional, based on a plurality of past reset signal time intervals.

Also, the printing apparatus of the present invention is provided with an ink jet head and a cleaning means for cleaning the ink jet head, with the control means including cleaning control for operating the cleaning means at a plurality of processing levels involving a variety of ink consumption quantities, wherein it is characterized by causing cleaning means to perform an initialization level cleaning involving ink consumption at a predetermined quantity if it is determined that the reset time interval falls within a predetermined range. Further, the memory means stores status information of the printing apparatus to enable the control means to select one out of a plurality of cleaning processing levels based on the status information to have the cleaning means perform said selected cleaning if it is determined that the reset time interval does not fall within a predetermined range.

In the present invention, the initialization level cleaning is performed if a reset is determined to be intentional, and a cleaning in an appropriate processing level is performed if a reset is determined to be unintentional. Furthermore, it is possible to conduct determination adapted to the environment in which the printing apparatus is installed, since whether or not a reset signal is intentional is determined based on a plurality of past reset time intervals.

Also, the printing apparatus of the present invention is characterized in that the reset signal processing means sends an external reset signal to the control means, and also sends an internal reset signal to the control means with delay of the predetermined time length from the external reset signal for initializing the control means by means of a hardware operation, wherein the control means sends a suppressing signal to the reset signal processing means for suppressing the internal reset signal if the reset time interval is determined not to fall within the predetermined range. In the present invention, if the reset is determined to not be intentional, the internal reset signal is suppressed to perform cleaning at an appropriate processing level. If the reset is determined to be intentional, the control means is initialized to perform cleaning at the initialization level. It is possible to maintain reliability as the control means can be initialized even if no suppressing signals is output when the control means is in an abnormal state.

Also, the printing apparatus of the present invention is characterized in that a control means stores at least the reset time interval into the nonvolatile memory means after receiving the external reset signal and before receiving the internal reset signal and sets a predetermined range based on a plurality of reset time intervals stored in the nonvolatile memory means after the internal reset signal is given and initialization process is performed and determines whether or not the nearest reset time interval falls within the predetermined range. By writing information once into the memory means before the control device is reset by means of hardware and reading it out of the memory means after the resetting to determine whether or not it is intentional, it is possible to maintain reliability of the control device, and at the same time, to minimize ink consumption by always performing cleaning at an appropriate processing level.

Also, the reset time interval may be directly measured with a timer, etc., or calculated from reset times.

The determination of whether or not the reset signal is intentional can be performed by determining the average value of the reset time intervals which fall within a predetermined length of time out of the past reset time intervals and setting the predetermined range based on said average value and by determining whether or not the nearest reset time interval falls within said predetermined range. The above mentioned predetermined length of time is desirably set at several seconds to several minutes, in view of cases in which reset signals are supplied continuously for several seconds to several minutes on start-up of a host computer or activation of an application running on a host computer.

Also, the determination of whether or not a reset signal is intentional can be performed by determining the median of the distribution of the reset time intervals which fall within a predetermined length of time out of the past reset time intervals and setting the predetermined range based on said median and by determining whether or not the nearest reset time interval is within said predetermined range. The above mentioned predetermined length of time is desirably set to more than several minutes, considering such cases as reset signals being supplied from an application when identical processings by the application, such as printing processing of receipts, is repeated at intervals of several minutes to several tens of minutes.

The present invention also relates to a method for controlling a printing apparatus, which will yield similar performance and effects.

Also, it is possible to provide a method for control in the present invention in which a control program is capable of running on a control device and can be supplied through recording media on which the control program is stored. The recording media may be Compact Discs (CD-ROMS), floppy disks, hard disks, magneto-optical discs, digital videodiscs (DVD-ROM), or magnetic tapes, and the program may be installed in an existing printing apparatus using these recording media. Furthermore, it is possible to post such a program on a WWW (World Wide Web) website to have users download the program for installation in an existing printing apparatus.

BEST MODE FOR CARRYING OUT THE INVENTION

Figure 1:
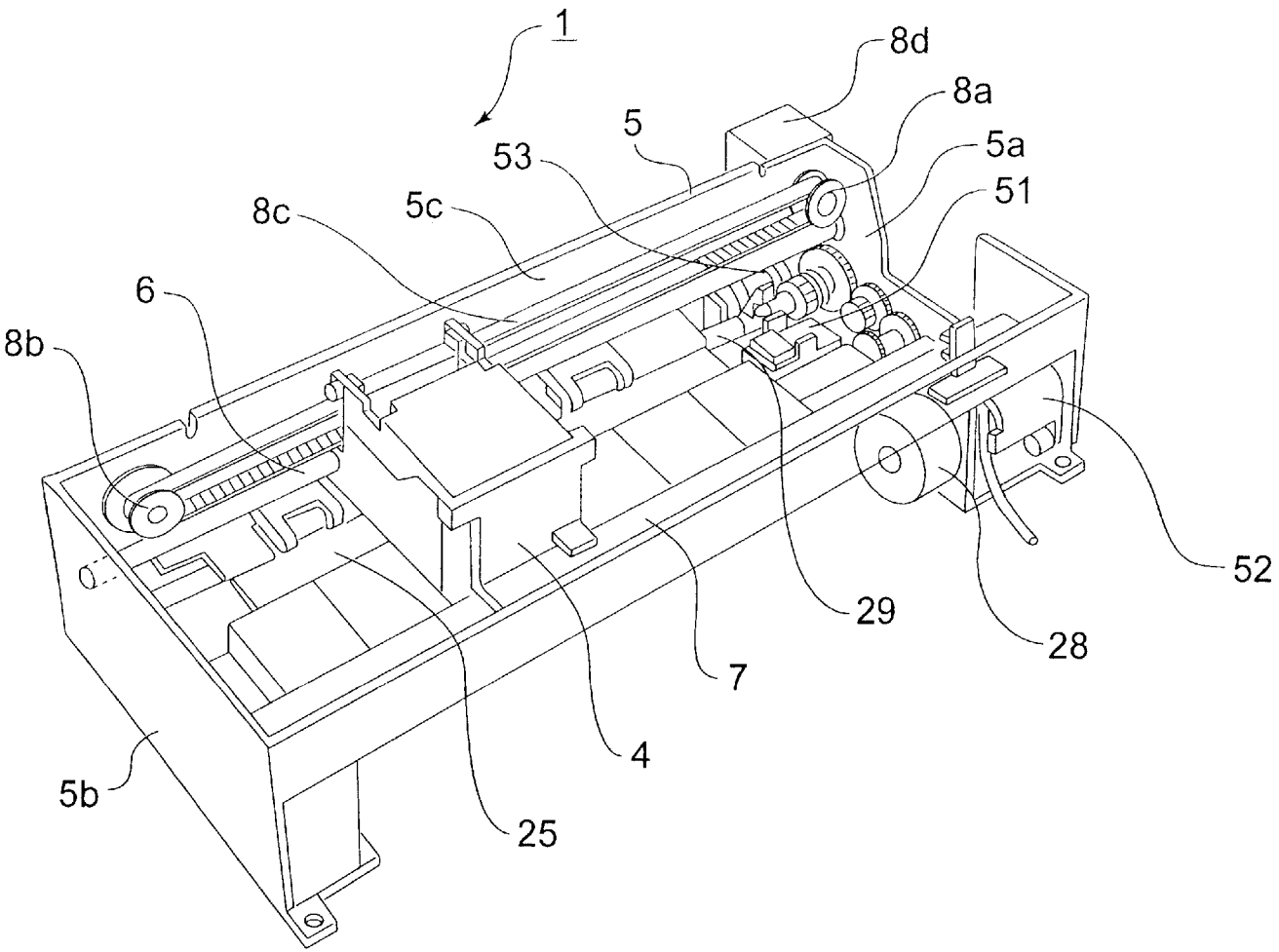
FIG. 1 is a schematic perspective view of the major components of a printer according to a preferred embodiment of the present invention.

Referring to the drawings, the ink jet printer of the present invention is described below.

First Embodiment

Figure 2:
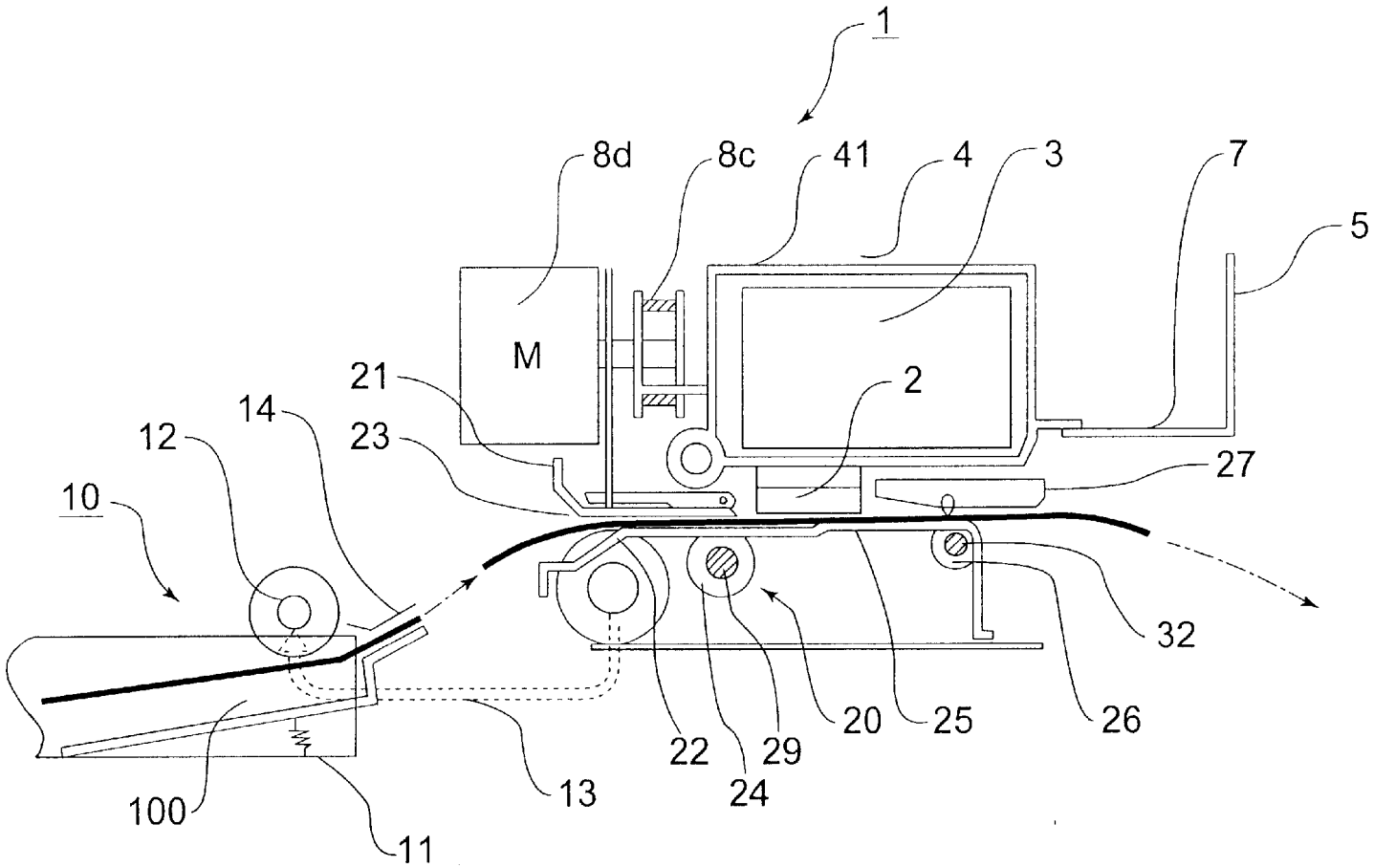
FIG. 2 is a schematic sectional view through the printing position in the printer shown in FIG. 1.

FIGS. 1 and 2 illustrate construction of the major components of a printer of the present invention. The printer 1 according to the present embodiment is a serial printer which prints by means of an ink jet head 2 and ink tank 3 mounted on a box-like carriage 4, which travels bidirectionally in a line scanning direction for printing. The ink jet head 2 and ink tank 3 are typically a cartridge which can be loaded into and removed from the carriage 4 by opening the top cover 41 of the carriage.

So that it can move bidirectionally on a linear path lengthwise to a frame 5, the carriage 4 is supported such that one side thereof can slide freely on a guide shaft 6 and the opposite side can slide freely on the top of a guide plate7. Both the guide shaft 6 and guide plate 7 are disposed between right and left side walls 5*a* and 5*b* of the frame 5.

A drive pulley 8*a* is mounted at one end of the front wall 5*c* of the frame 5, and a driven pulley 8*b* is mounted at the other end. A timing belt 8*c* connects the two pulleys 8*a* and 8*b*, and is also connected to the front of the carriage 4. When the drive pulley 8*a* is turned by a carriage motor 8d mounted at the front wall 5*c* of the frame 5, the carriage 4 connected to the timing belt 8*c* is moved by the timing belt 8*c* along the guide shaft 6.

An automatic paper feeding mechanism 10 for supplying a cut sheet form 100 is provided in front of the frame 5. The automatic paper feeding mechanism 10 comprises a cassette 11 for holding a plurality of cut sheet forms 100, a feed roller 12 for feeding the cut sheet forms 100 one sheet at a time from the cassette 11, a power transfer mechanism 13 (indicated by double dotted lines in the figure) for transferring drive power to the feed roller 12 and a paper path 14 for guiding the cut sheet form 100 from the cassette 11 to a position from which a cut sheet transport mechanism 20 inside the frame 5. The drive source of the feed roller 12 is commonly used as the drive source of the cut sheet transport mechanism 20. Accordingly, the power transfer mechanism 13 comprises a clutch mechanism whereby the power transfer mechanism 13 is held in an OFF state during normal printing operations, switches to an ON state only when necessary, and thereby transfers drive power to the feed roller 12 as needed.

The cut sheet transport mechanism 20 in the frame 5 comprises a cut sheet insertion opening 23, which is defined by a pair of upper and lower guide plates 21 and 22, on the side of the front wall 5*c* of the frame. When a cut sheet form 100 is fed by the automatic paper feeding mechanism 10 to the cut sheet insertion opening 23, it is then grasped by a transport roller 24. The transport roller 24 then transports the cut sheet form 100 through a transportation path defined by a guide plate 25, which is mounted opposite to the ink jet head 2. The cut sheet form 100 is then carried by another transport roller 26 through and out of a paper exit 27 at the back of the frame 5.

A transportation motor 28 mounted at the back side of the frame 5 powers the cut sheet transport mechanism 20. Torque from the transportation motor 28 is transferred through a gear set to a transportation roller shaft 29, and then by the transportation shaft 29 and another gear set on the opposite end to another transportation roller shaft 32.

The carriage 4 is thus driven bidirectionally through a predetermined printing area so that the ink jet head 2 mounted on the carriage 4 prints on the surface of the cut sheet form 100 transported to the printing position as described above. In the present embodiment, the carriage 4 can also move outside the printing area to a position near the side wall 5*a* of the frame 5. The area outside the printing area includes a home position of the ink jet head 2, a cleaning position whereat ink jet head 2 cleaning is performed, and a cut sheet form supply position whereat the automatic paper feeding mechanism 10 is driven to supply form.

A head capping mechanism 51 is provided for capping the nozzles of the ink jet head 2, an intake pump mechanism 52 is provided for suctioning and collecting waste ink from the ink jet head 2 and the head capping mechanism 51, and a clutch mechanism 53 for switching the power transfer path 13 of the automatic paper feeding mechanism 10 from the OFF state to the ON state. Head capping mechanism 51, intake pump mechanism 52 and clutch mechanism 53 are positioned between the edge of guide gate plate 25, which determines printing position, and frame side wall 5*a*.

Figure 3:
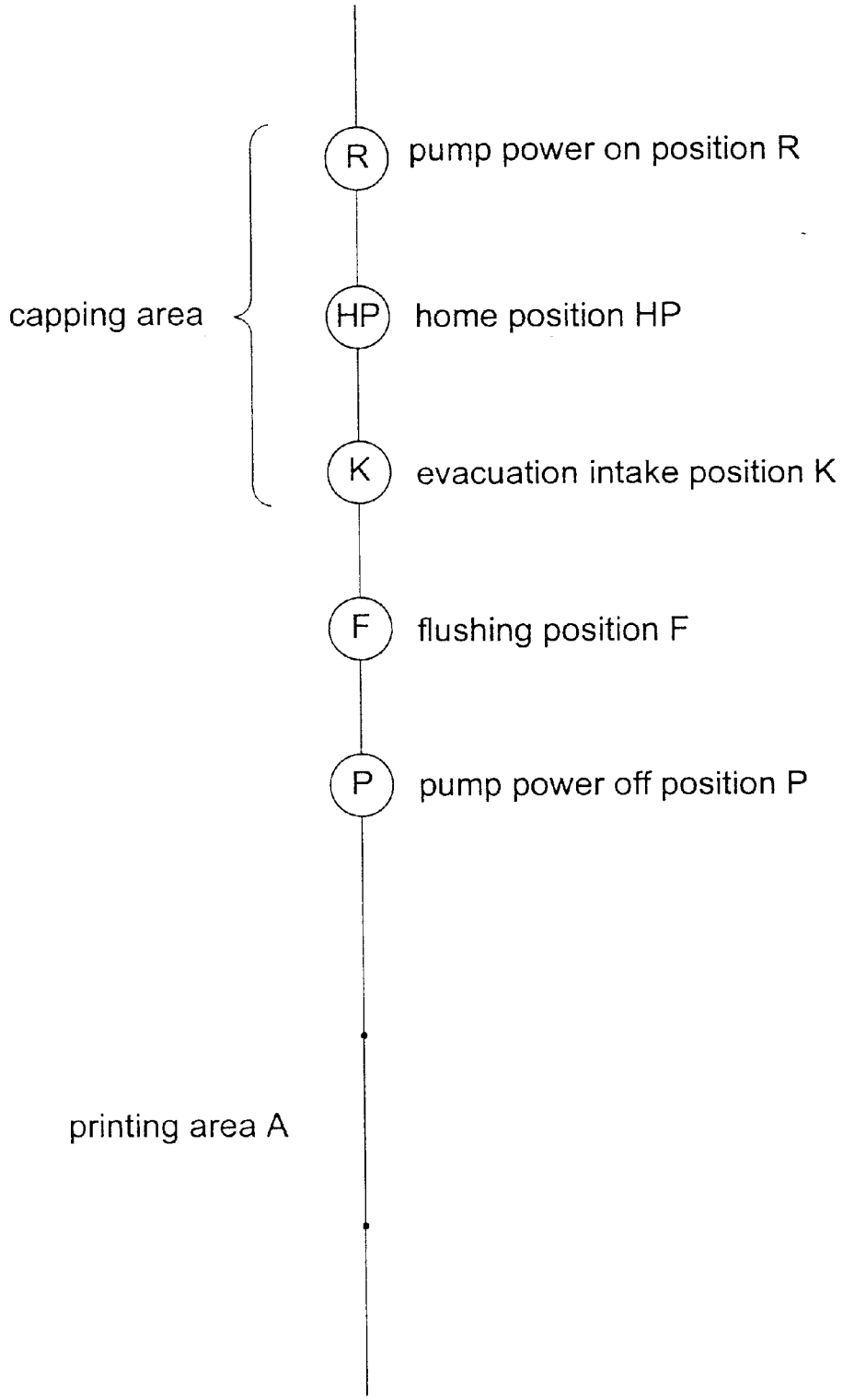
FIG. 3 is a schematic illustration of various positions at which ink jet head cleaning occurs in the printer shown in FIG. 1.

The positions whereat the carriage 4, and thus the ink jet head 2, stops moving, and the operations performed at each of those positions, are shown in FIG. 3. The carriage 4 movement can be detected by a photosensor or a mechanical microswitch, etc., and the carriage 4 can be stopped at each position based on the detection signals.

As shown in FIG. 3, the stopping positions of the carriage 4 are arranged in sequence from the edge of the printing area A toward the side wall 5*a* of the frame 5 in the order of a pump power OFF position P, a flushing position (pre-eject position) F, an evacuation intake position K, the home position HP, and the pump power ON position R. Operation in each position is as follows.

Pump power OFF position P: This is the position at which drive power from the transportation motor 28 is switched from the intake pump mechanism 52 to the cut sheet transport mechanism 20 to stop intake pump mechanism 52 operation.

Flushing position F: This is the position at which all nozzles of the ink jet head 2 are flushed by a preliminary ink ejection operation. Flushing ejects ink of which the viscosity has increased (high viscosity ink) from any unused nozzles, for example. The ink jet head 2 nozzles are located opposite to the head capping mechanism 51 in this position, and ink droplets flushed from the nozzles are captured by the head capping mechanism 51.

Evacuation intake position K: The ink jet head 2 nozzles are capped by the head capping mechanism 51 in this position. This is where the intake pump mechanism 52 evacuates captured ink from the head capping mechanism 51.

Home position HP: This is the default position for the carriage 4, that is, this is where the carriage 4 is positioned after the power is turned ON. The ink jet head 2 is covered by the head capping mechanism 51 in this position. Capping the nozzles prevents such problems as an increase of the viscosity of the ink as a result of evaporation of an ink solvent from inside the nozzles, and ink meniscus retraction. Also, supplying of a cut sheet form is performed in the home position HP.

Pump power ON position R: This is the position at which drive power from the transportation motor 28 is switched from the cut sheet transport mechanism 20 to the intake pump mechanism 52 to enable intake pump mechanism 52 operation. The drive power of the transportation motor 28 switched to the intake pump mechanism 52 at this position returns to the cut sheet transport mechanism 20 after the carriage 4 moves toward the printing area A passing the pump power OFF position P.

The ink jet head 2 is capped by the head capping mechanism 51 throughout the range from the evacuation intake position K to the pump power ON position R. Hereinafter, this area is referred to as the capping area.

Figure 4:
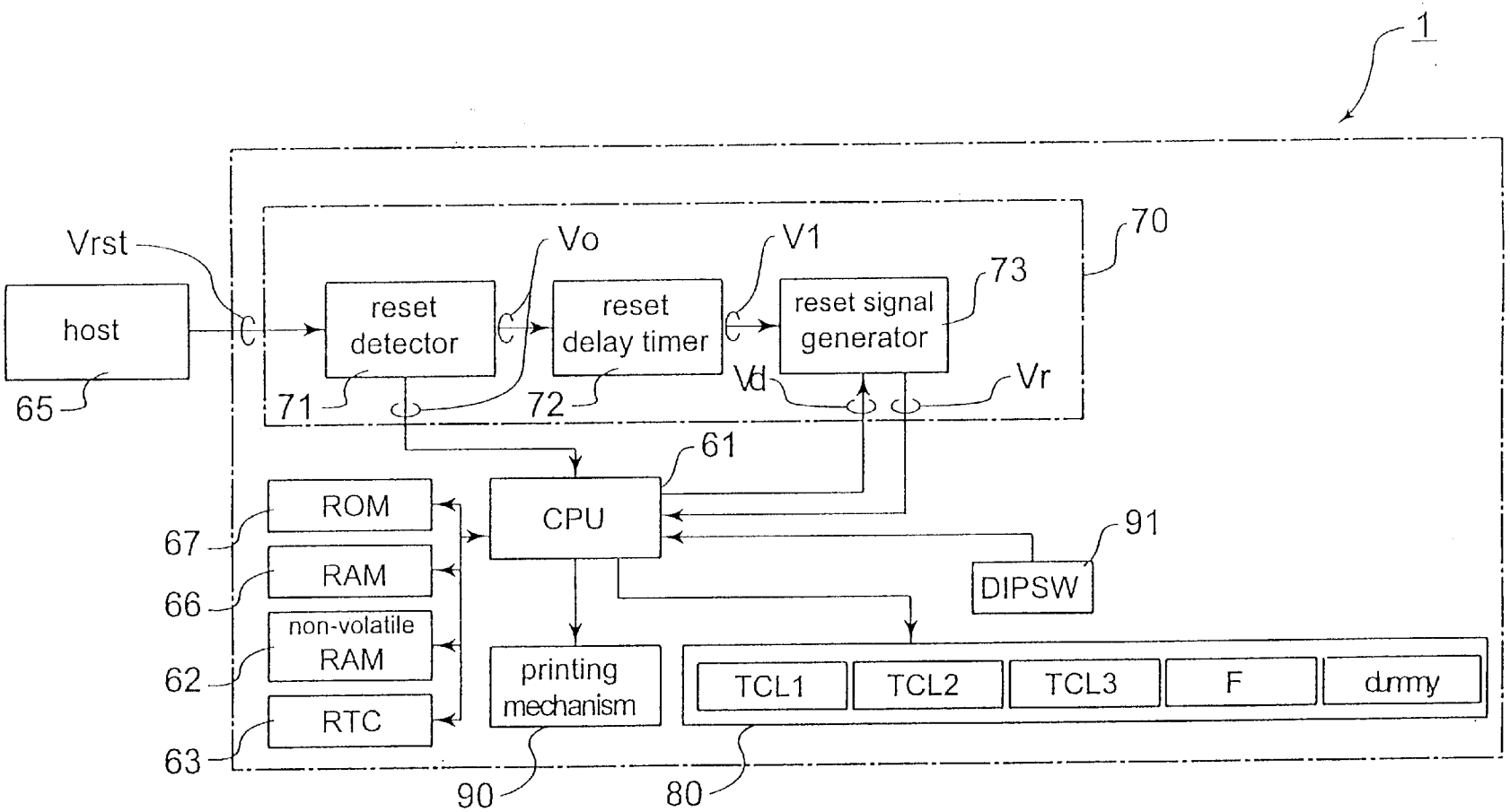
FIG. 4 is a block diagram of a control system according to a first embodiment of the present invention.

The operation performed at each of the stopping positions is controlled by a control device, typically comprising a CPU. A block diagram of a control system of the printer 1 according to the present embodiment is shown in FIG. 4. As shown in this figure, the printer 1 comprises a printing mechanism 90 which includes a mechanism for moving the cartridge 4 mounting the ink jet head 2 to a specific position, the control device (CPU) 61 which controls the printing mechanism 90 and an ink system 80 (to be described below), and a reset signal processing unit 70 for resetting the printer 1 based on a reset signal Vrst received from a host computer 65. The reset signal processing unit 70, when a reset signal Vrst is received, supplies an external reset signal V0 to the CPU 61 to notify the CPU 61 that an external reset signal was received. After waiting a specific delay period from receipt of the reset signal Vrst, the reset signal processing unit 70 then generates an internal reset signal Vr and applies it to the CPU 61 to reset the CPU 61.

Also, the printer 1 comprises a real time clock (RTC) 63 as a time measuring device which is capable of obtaining the current time and a nonvolatile RAM 62 such as EEPROM, etc., as a memory device which allows the writing of the current tb time as a reset time upon recognition by the CPU 61 of the external reset signal V0. It is possible to write into the nonvolatile RAM 62 not only reset time but also printer status information including at least a cleaning history. The CPU 61 is connected to a RAM 66 which serves as a working memory area, and to the nonvolatile RAM 62 and a ROM 67 which stores control programs, etc. When the external reset signal V0 is input, a program (described below) will be loaded from the ROM 67 to the RAM 66 based on the information written in the nonvolatile RAM 62 for execution of the printer 1 control.

Based on the information read from ROM 67 and non-volatile RAM 62, the CPU 61 instructs the ink system 80 to perform one of five cleaning operations, which differ by the amount of ink consumption, that is, cleaning level 1 (TCL1), cleaning level 2 (TCL2), cleaning level 3 (TCL3), flushing (F), and dummy cleaning (dummy). The amount of ink consumed increases in the following sequence:

dummy, F, TCL1, TCL2, and TCL3. No ink is consumed in the dummy cleaning process.

The cleaning process performed at cleaning levels TCL1, TCL2, and TCL3include: a process for suctioning ink from the nozzles to remove high-viscosity ink and bubbles from the ink path, a so-called wiping process in which the head surface is cleaned by wiping with a rubber blade, and a so-called rubbing process in which the head surface is wiped with a sponge as may be further required. The contents and conditions of each of these cleaning levels are described briefly below.

Cleaning TCL1: If, based on cleaning history information read from the non-volatile RAM 62, less than 96 hours have elapsed since the ink jet head 2 was last cleaned at cleaning level TCL1 or greater, and 15 hours or more have elapsed since the ink jet head 2 was set to a stand-by mode, that is, since the ink jet head 2 was uncapped, cleaning level TCL1 is selected. At TCL1, all ink inside an ink ejection chamber of the ink jet head 2 is suctioned, and a known amount of ink is therefore consumed. For purposes of comparison, ink consumption at this cleaning level TCL1 has a (relative) volume of 1.

Cleaning TCL2: Cleaning level TCL2 is selected if 96 hours or more and less than 168 hours have elapsed since the last cleaning operation at cleaning level TCL1. This is again decided based on the cleaning history read from non-volatile RAM 62. The TCL2 level cleaning process suctions all ink from inside the head unit. Ink consumption has a volume of 8 in this case.

Cleaning TCL3: Cleaning level TCL3 is selected if 168 hours or more have elapsed since the last cleaning operation at cleaning level TCL1. This is also decided based on the cleaning history read from non-volatile RAM 62. The TCL3 level cleaning process suctions all ink from inside the ink path. Ink consumption has a volume of 40 in this case. This cleaning process consumes the most ink in printer 1.

Flushing F: The flushing F process is selected if less than 15 hours have elapsed since the ink jet head 2 was uncapped. The flushing F process pumps the nozzles 40 to 1000 times to simply eject ink from and near the nozzles. Ink consumption has a volume of 0.0025 to 0.06 in this case.

Dummy cleaning: After flushing F, dummy cleaning wipes the head surface, caps the head, and evacuates captured ink, but does not by itself consume ink. In a preferred embodiment of the invention, this dummy cleaning can be enabled and disabled by means of a DIP switch 91. The printer 1 of the preferred embodiment is designed to execute a dummy cleaning which can perform almost the same operation as the initialization level cleaning, involving no ink consumption, so that it is possible to clearly signal to a user that the printer 1 is receiving external reset signals without fail, avoiding wasteful misunderstanding that cleaning is not being conducted.

In the printer 1, the printing mechanism 90 is also initialized along with these cleaning processes. This initialization includes moving the cartridge 4 to the home position.

The reset signal processing unit 70 comprises a reset detector 71 for detecting the reset signal Vrst from the host computer 65 to output the external reset signal V0, a reset delay timer 72 for outputting a delayed reset signal V1 after waiting a specific delay period from input of the external reset signal V0 from the reset detector 71, and a reset signal generator 73 for outputting the internal reset signal Vr to the CPU 61 by inputting the delayed reset signal V1. The reset signal generator 73 generates a reset signal suitable for the CPU 61 (such as pulse width, rising time of pulse, falling time of pulse, and voltage value, etc.). The internal reset signal Vr causes the CPU 61 to perform the same initialization process performed when the power switch of the printer 1 is turned ON. Applying the internal reset signal Vr to the CPU 61 causes an initialization process including initializing the printing mechanism 90, and initialization of the program and data cleanup in the RAM66. Output of the internal reset signal Vr is suppressed by a disable signal Vd which is output by the CPU 61 to the reset signal generator when the CPU 61 detects the external reset signal V0.

It should be noted that the external reset signal V0 is preferably applied to the Non Maskable Interrupt (NMI) terminal of the CPU 61. This allows certain recognition of generation of external reset. The internal reset signal Vr is also preferably applied to the reset (RST) terminal of the CPU 61. This allows the CPU 61 to certainly execute a reset operation in response to the external reset signal.

Figure 5:
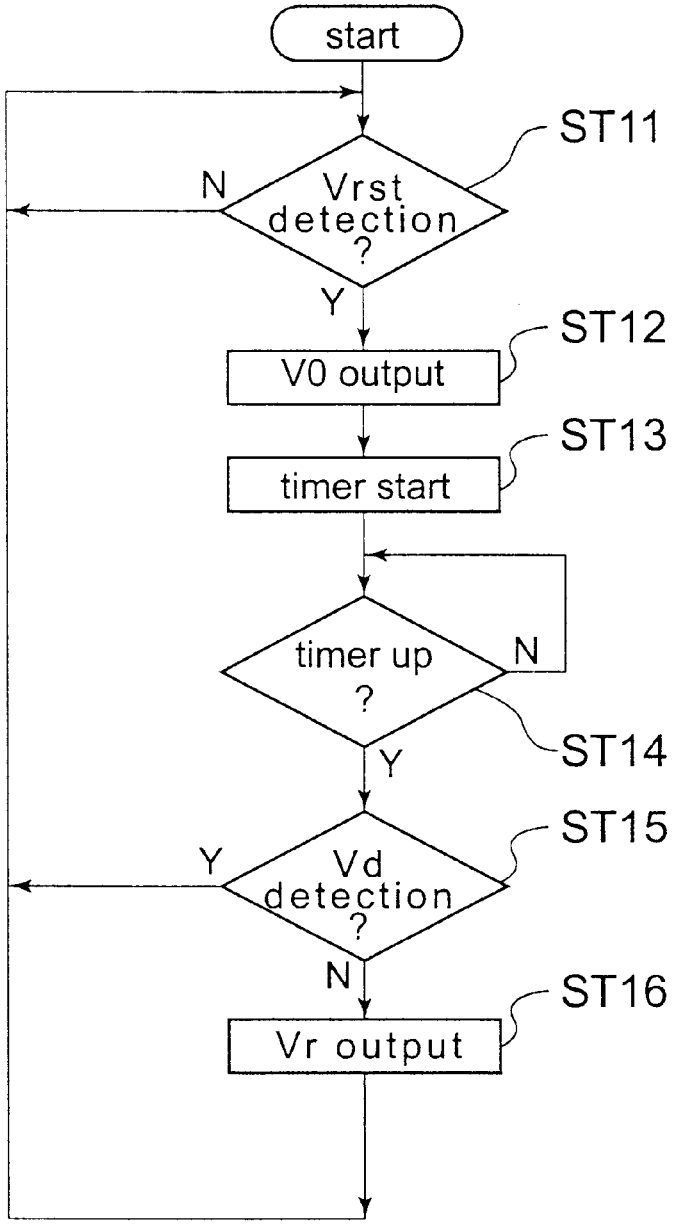
FIG. 5 is a flow chart of reset signal processing by means of the reset signal processing device.

FIG. 5 is a flow chart of the process from receiving the reset signal Vrst from the host computer to the output of the internal reset signal Vr to the CPU 61. As shown in the figure, in step ST11, the external reset signal V0 is output if the reset signal Vrst is detected by the reset detector 71 (ST12). Upon receipt of the signal the reset delay timer 72 is activated (ST13). After passage of the predetermined period the reset delay timer 72 outputs the delayed reset signal V1 (ST14) to determine whether or not the disable signal Vd is output. If no disable signal Vd is output (ST15; NO), the reset signal generator 73 outputs the internal reset signal Vr to the CPU 61 (ST16). On the other hand, if the disable signal Vd is output, (ST15; Yes) the internal reset signal Vr is not output. The external reset signal V0 output by said reset detector 71 is input to said reset delay timer 72 and the CPU 61.

The external reset signal V0 input to the said reset delay timer 72 works as a trigger for activating the reset delay timer 72 as described above. After this trigger is given, no internal reset signal Vr is given from the reset signal generator 73 up until passage of the predetermined delay time of, for example, 100 milliseconds. On the other hand, external reset signal V0 is given to the CPU 61 with the same timing as that given to the reset delay timer 72. This allows the CPU 61 to recognize that the reset signal Vrst is transmitted from the host computer 65.

The CPU 61 outputs a disable signal Vd to the reset signal generator 73 upon recognition of transmission of the reset signal Vrst, or upon detection of the external reset signal V0 and stores the reset time into the nonvolatile RAM 62. at this time various status information from the printer 1, and the fact that reset signal Vrst is transmitted, may be stored in the nonvolatile RAM 62. Printer status information to be stored may include status information relating to the printing mechanism portion such as the carriage position or whether or not an ink cartridge is inserted, value of the ink end counter which shows remaining quantity of ink, or information regarding to cleaning if any cleaning is conducted at the time of reset.

Alternatively, the CPU 61 may be made to store any printer status information in the nonvolatile RAM 62 after the predetermined time interval or after the execution of any cleaning step, separately from the timing of input of the reset signal V0. Among status information to be recorded after execution of any cleaning processing included is the time when said cleaning is executed. In this instance, the execution time may be stored for each processing level or the execution time of any cleaning of a predetermined level or higher, for example, TCL1 or higher, may be stored. Also, among regularly stored status information may be included the time of nozzle capping release and print pulse counter value that indicates the amount of printing executed.

Figure 6:
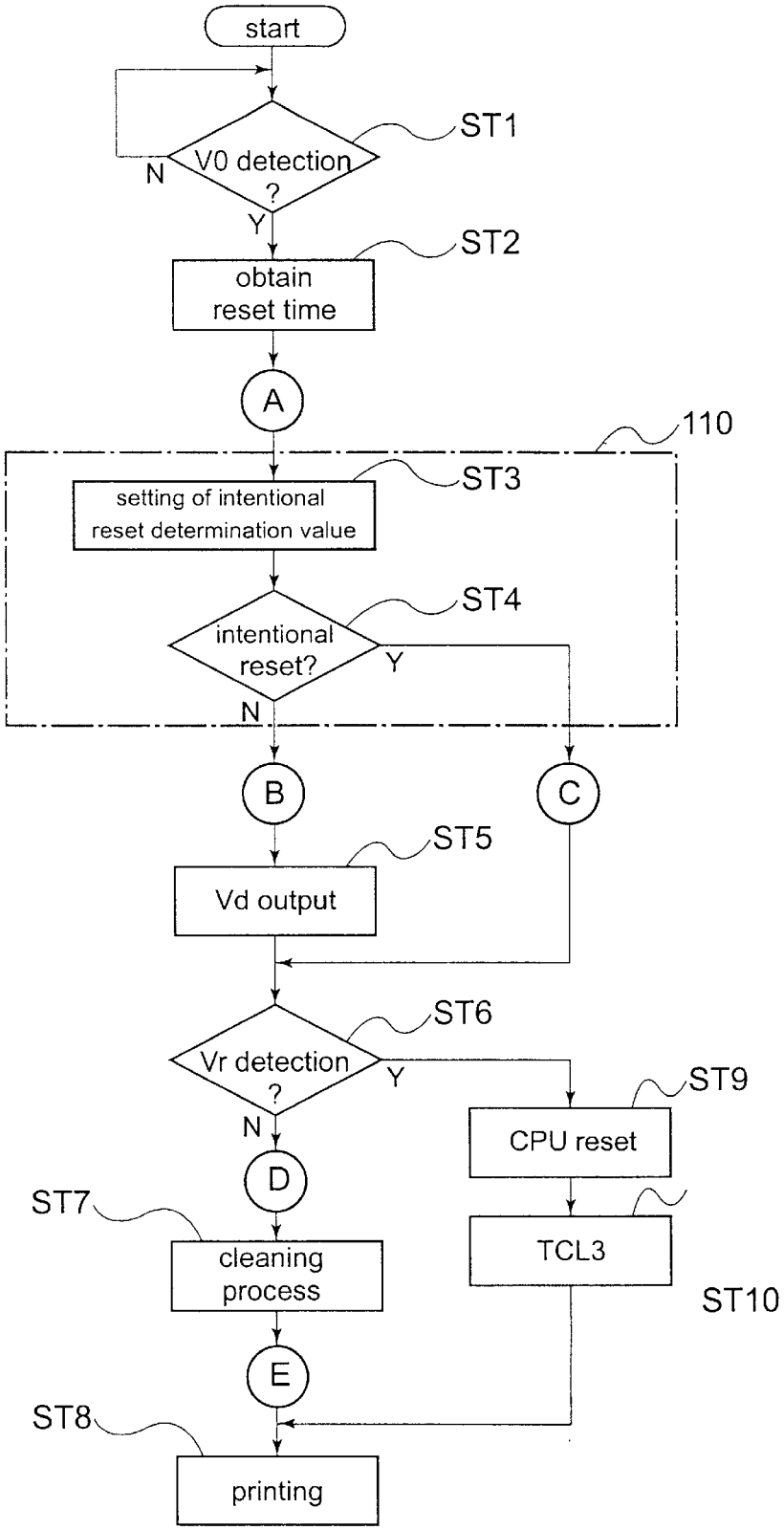
FIG. 6 is a flow chart illustrating the control operation by means of the control system shown in FIG. 4.
Figure 7:
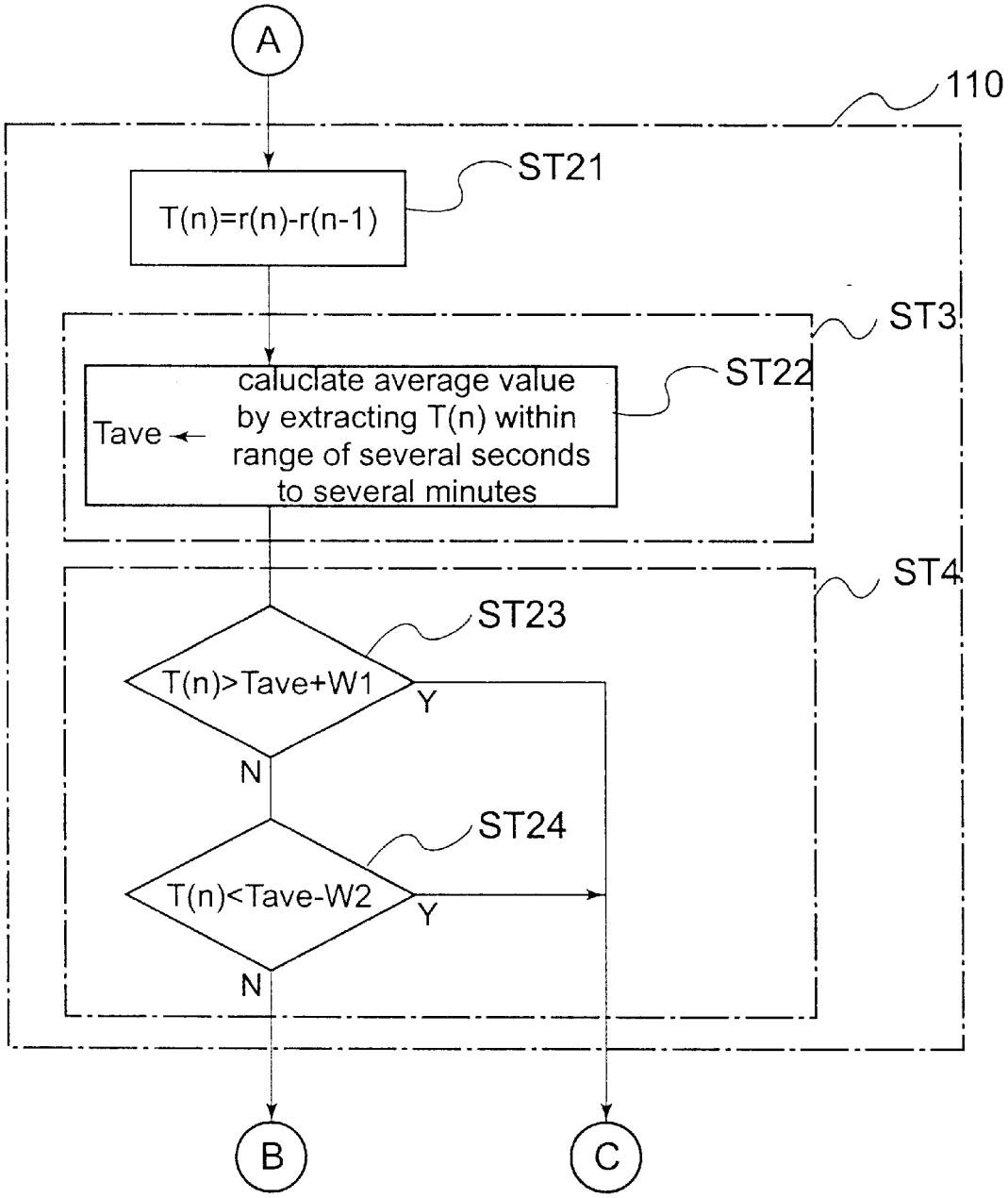
FIG. 7 is a flow chart of processing for determining whether or not a reset is intentional.
Figure 8:
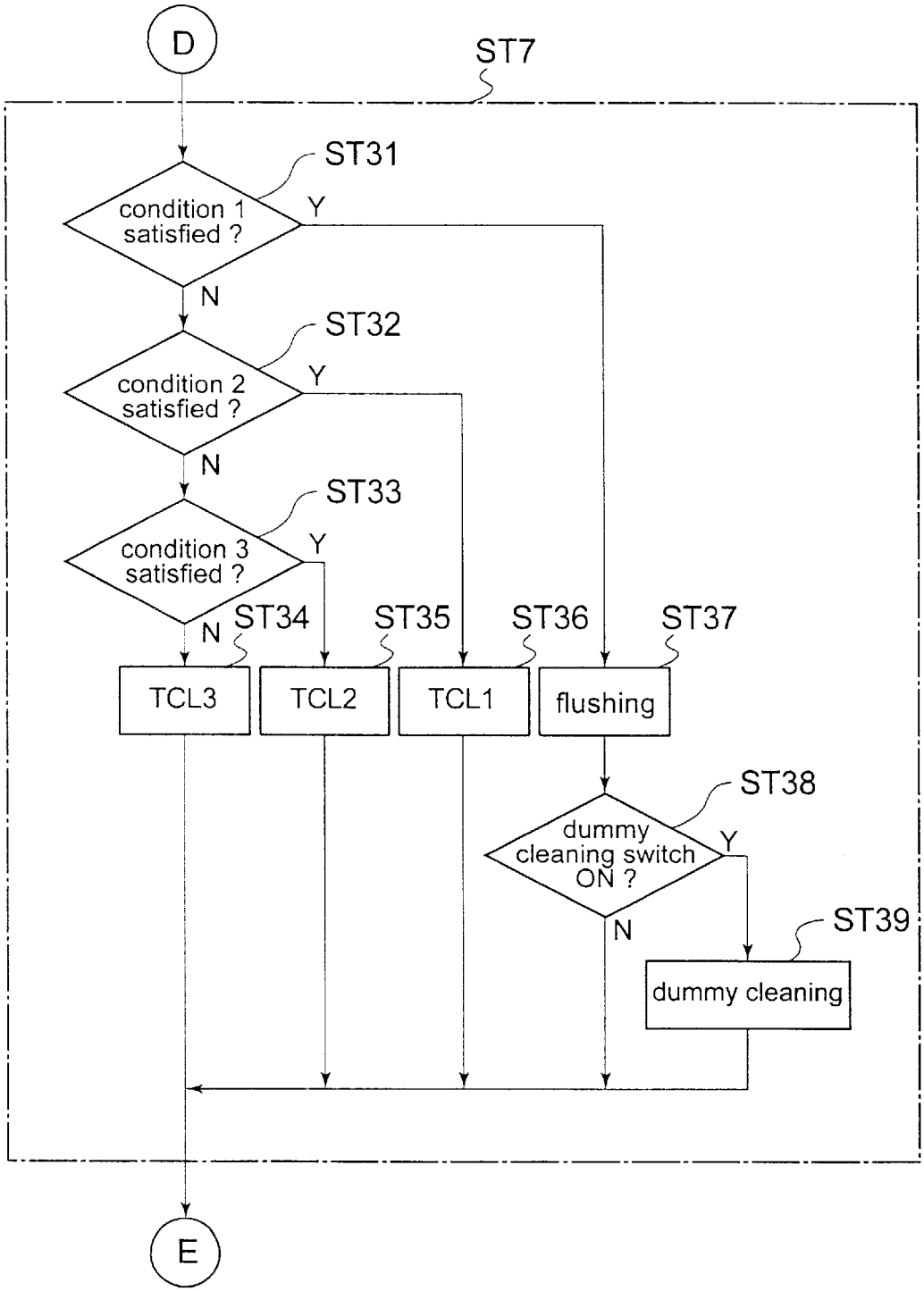
FIG. 8 is a flow chart illustrating the cleaning processing in detail.

FIGS. 6 to 8 are flow charts illustrating cleaning processing operation of the printer 1. As shown in FIG. 6, in step ST1, the CPU 61 detects the external reset signal V0 from the reset detector 71, and in Step ST2 the current time is read out from RTC 63 as reset time r(n). Next, in step ST3 a reset time interval T(n) is calculated from the nearest reset time r(n−1) and the current reset time r(n) to seek average value Tave of said reset time interval for setting as a determination value. Then, in step ST4 determination is made as to whether or not the nearest reset time interval T(n) falls within the predetermined range in comparison with the determination value Tave calculated in step ST3. By this procedure, it is determined whether or not the reset signal is intentional.

If it is determined not to be intentional (ST4; NO), the procedure proceeds to step ST5 and the CPU 61 outputs a disable signal Vd to the reset, signal generator 73 to suppress output of the internal reset signal Vr. Accordingly, the CPU 61 is not reset, and reset processing by software corresponding to the program is executed to instruct, in step ST7, the ink system 80 to conduct cleaning processing at an appropriate level. Then, after this cleaning is completed, printing starts at step ST8.

Also, if a reset is determined to be intentional (ST4; Yes), the CPU 61 does not output the disable signal Vd to the reset signal generator 73 and the internal reset signal Vr is supplied to the CPU 61 to reset the CPU 61 by means of hardware (step ST9). Then, in step ST10, an initialization level cleaning TCL3 is executed. After this cleaning is completed, printing starts in step ST8.

FIG. 7 is a flow chart illustrating the process 110 for determining whether or not a reset is intentional. The CPU 61 calculates the nearest reset time interval T(n) from the reset time r(n) and the nearest reset time r(n−1).

Next, in step ST22, only those reset time intervals falling within a range of several seconds to several minutes are extracted out of the past reset time intervals T to calculate an average value Tave for extracted reset time intervals T. The average value Tave is set as a determination value for determining whether or not a reset is intentional.

Next, in step ST23 and step ST24, the nearest reset time interval T(n) is determined whether or not it is an intentional reset, depending on whether or not it falls within a predetermined value by comparison with the determination value Tave. In step ST23, determination is conducted to determine whether or not the nearest reset time interval T(n) is larger than (Tave+W1). If it is not T(n)>(Tave+W1), the process will proceed to step ST24 to determine whether or not the nearest reset time interval T(n) is smaller than (Tave−W2). If it is not T(n)<(Tave−W2), the reset is determined to not be intentional. On the other hand, conditions of step ST23 or step ST24 is satisfied, the reset is determined as being intentional.

FIG. 8 shows a processing for selecting an appropriate cleaning level in step ST7. First, in step ST31, the length of time passing from the previous cleaning is sought from the time of the previous cleaning read out from the nonvolatile RAM 62 and the time read out from RTC63 after the reset. Also, the length of time passing after nozzle capping is released is sought from the pause time read out from the nonvolatile RAM 62 and the time read from RTC63. By referring to these lengths of time passed, determination is made of whether or not the condition 1 or a condition that the length of time passed after a cleaning of process level TCL1 or higher is less than 96 hours and capping release time is less than 15 hours is satisfied. If the condition 1 is satisfied, in step ST37, the carriage 4 is moved to the flushing position F, and a flushing processing is executed on the ink jet head. Furthermore, after flushing is conducted, in step ST38, the state of the DIP switch 91 is confirmed and a dummy cleaning is conducted in step ST39 only if execution of a dummy cleaning is selected. If the dummy cleaning is not selected, said processing is not executed and printing starts in step ST8.

In step ST31, if the condition 1 is found to not be met, then in step ST32, determination is conducted as to whether or not the condition 2 or a condition in which the length of time passing after cleaning of process level TCL1 or higher is less than 96 hours and capping release time is 15 hours or more is satisfied. In this instance, if the condition 2 is found to be met, then the processing proceeds to step ST36 for execution of TCL1 cleaning process involving low ink consumption. Upon completion of TCL1 cleaning processing, printing starts in step ST8.

If, in step ST32, the condition 2 is not met, in step ST33, determination of whether or not the condition 3 or a condition in which the length of time after the cleaning of TCL1 or higher was conducted falls within a range from 96 hours to 168 hours is met. If the condition 3 is met, the processing moves to step ST35 to execute TCL2 cleaning process that involves moderate ink consumption. After the TCL2 cleaning process is completed, printing starts in ST8.

If, in step ST33, the condition 3 is not met, or if the length of time after the cleaning of TCL1 or higher was conducted is more than 168 hours, the processing moves to step ST34 to execute TCL3 cleaning processing having the maximum ink consumption. After the TCL3 cleaning processing is completed, printing starts in ST8.

Figure 9:
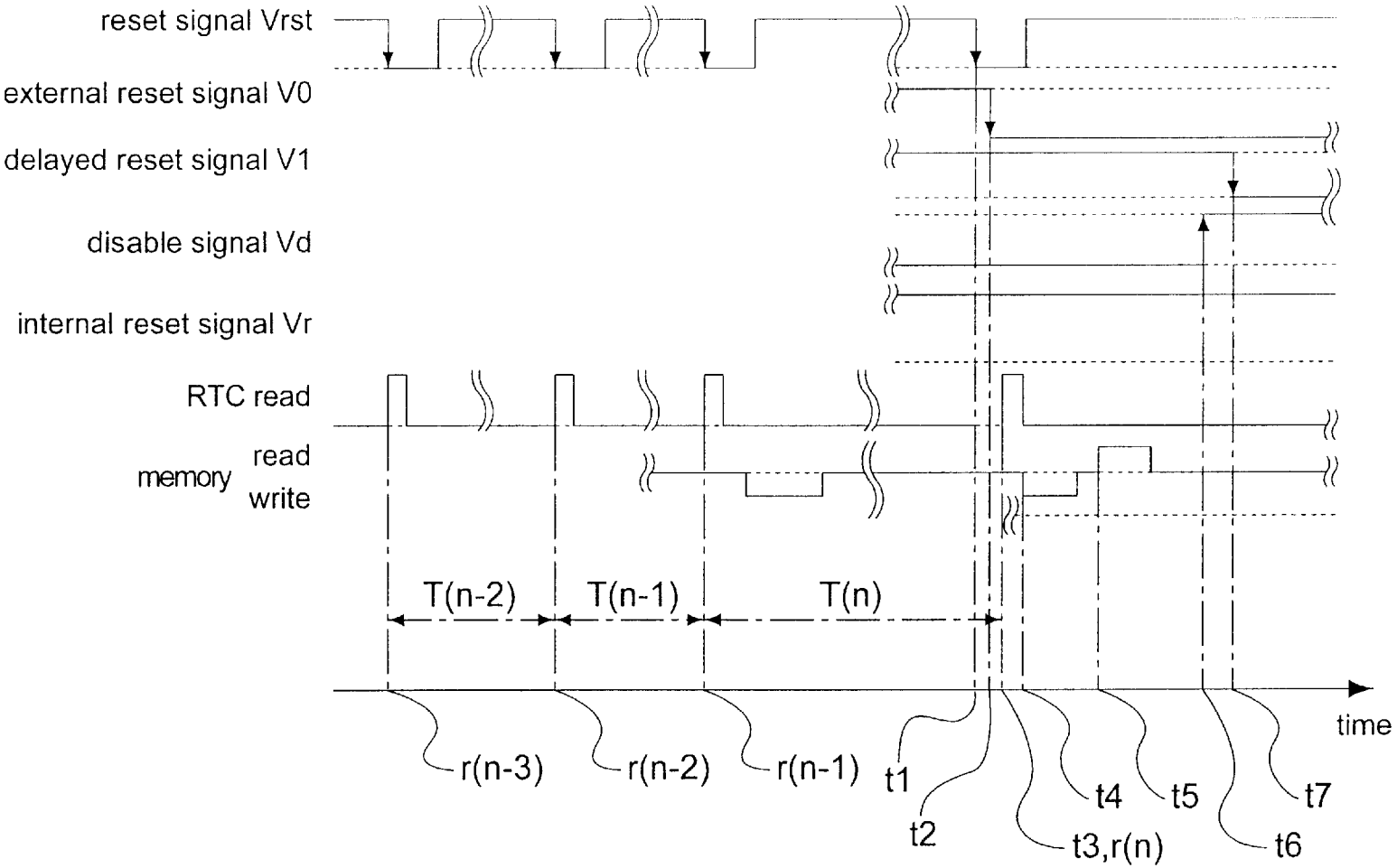
FIG. 9 is a time chart of various signals.
Figure 10:
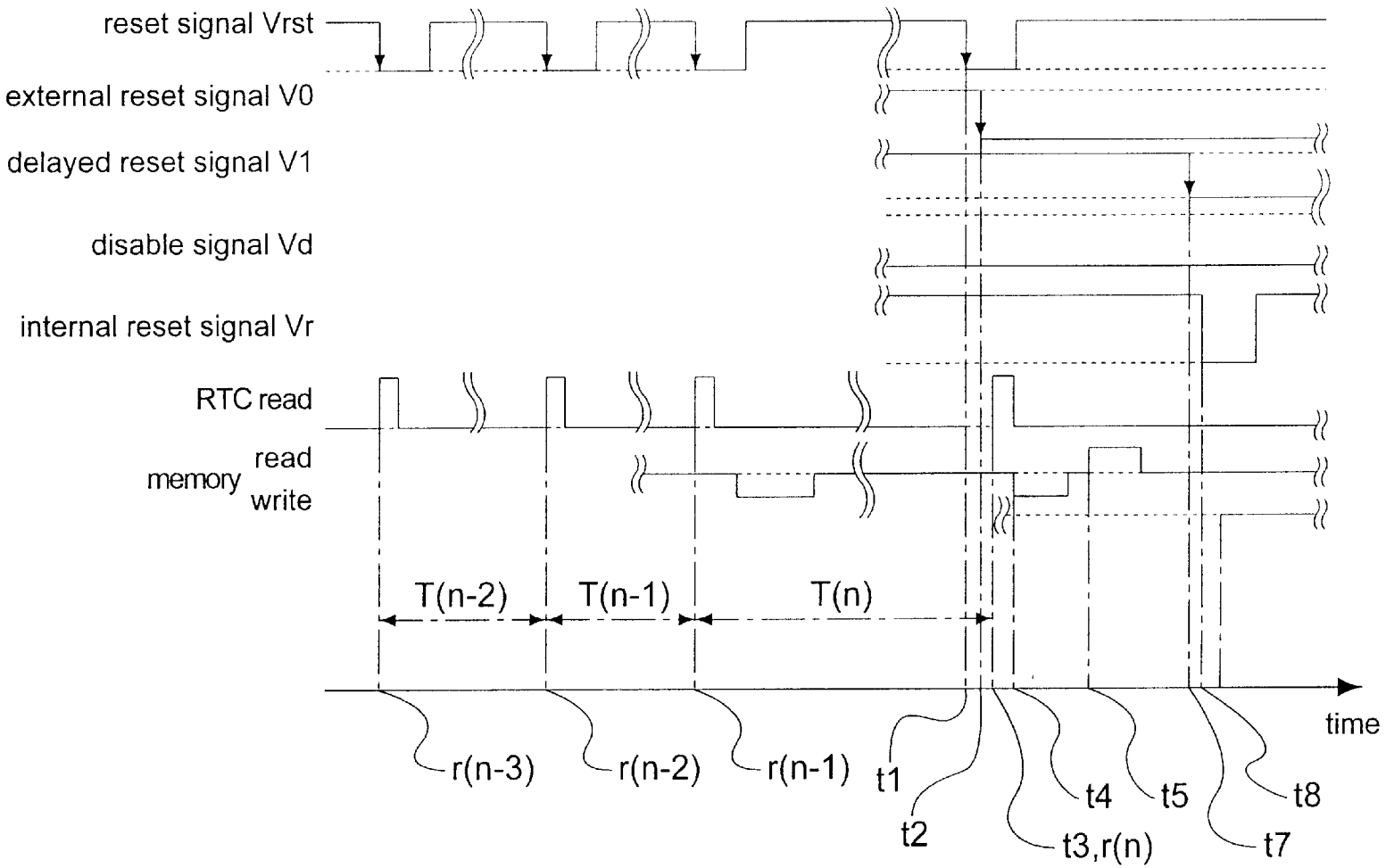
FIG. 10 is a flow chart for the case where no disable signal is generated.

In FIG. 9, a timing chart is shown for the case when the disable signal Vd is output; and in FIG. 10, a timing chart is shown for the case when the disable signal Vd is not output. In the figures, at time t1, if the reset detector 71 receives the reset signal Vrst, at time t2 or the next timing, the external reset signal V0 is output from the reset detector 71 to the CPU 61 and the reset delay timer 72. Upon receipt of the external reset signal V0, the CPU 61 read out from RTC63 time t3 as a reset time r(n), and at time t4 it stores various status information of the printer, including the reset time r(n), into the nonvolatile RAM 62.

At time t5, past reset times r(n−1), r(n−2) and r(n−3) are read out from the nonvolatile RAM 62 to calculate each reset time intervals T(n), T(n−1), and T(n−2) for seeking average value Tave to set it as a determination value for determining whether or not the reset is intentional.

At time t6, the CPU61 outputs a disable signal Vd to the reset signal generator 73, resulting in a state where output is suppressed of the internal reset signal Vr from the reset signal generator 73 to the CPU 61. Accordingly, the internal reset signal Vr is not output and the CPU 61 executes a reset processing by means of software corresponding to the program.

On the other hand, as shown in FIG. 10, at time t7, if no disable signal Vd is output, at time t8, the internal reset signal Vr is output to reset the CPU 61 by means of hardware.

As described above, in the printer 1 of this example, the CPU 61 is not reset by means of hardware, even if the reset signal Vrst is supplied to the printer 1 and determination is conducted based on a plurality of the past reset time intervals T as to whether or not a reset is intentional, which enables appropriate determination corresponding to an environment in which the printer 1 is utilized. Also, it is possible to maintain reliability of printing while suppressing ink consumption since selection of a cleaning with an appropriate level can be made based on the cleaning history of the printer 1.

In the printer 1 of this example, determination is conducted as to whether or not a reset signal Vrst is intentional based on a plurality of the past reset time intervals T, and furthermore, the range for determination is renewed from time to time so as to in be an appropriate range. Accordingly, it is possible to prevent excessive ink consumption, increasing the quantity of ink actually usable in an ink cartridge, to prolong cartridge life. This results in reduced frequency of ink cartridge changes, decreasing operating costs. Also, this reduces the number of discarded cartridges, which is beneficial in conservation and environmental protection.

Also, in the printer 1 of this example, if the reset signal Vrst is intentional, or if no disable signal Vd is output from the CPU 61 due to any cause, the internal reset signal Vr forcibly initializes the CPU 61 along with execution of a cleaning at the initialization level. Accordingly, even if the CPU 61 is in some abnormal state, reliability of the printer is enhanced as it has a protective function to reset the CPU 61 by means of hardware.

Figure 11:
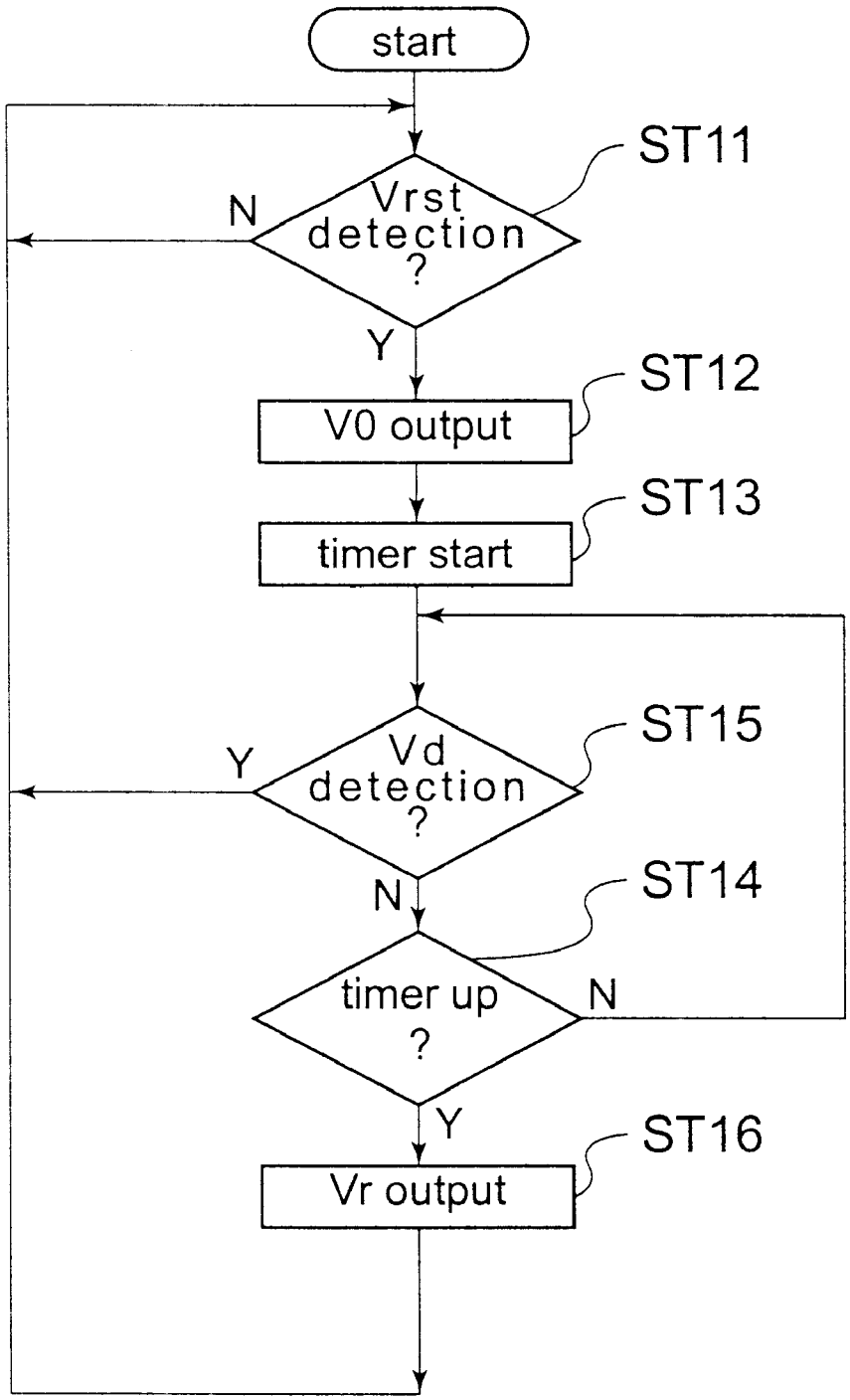
FIG. 11 is a flow chart illustrating a reset signal processing which differs from the reset signal processing shown in FIG. 5.

To achieve such protective function, the reset signal processing shown in FIG. 5 is conducted, but instead of masking output of the internal reset signal Vr by the reset delay timer 72 as shown in FIG. 5, masking output of the internal reset signal Vr may be achieved by conducting step ST15 processing for identifying the disable signal Vd during counting in the reset delay timer 72 as shown in FIG. 11.

Figure 12:
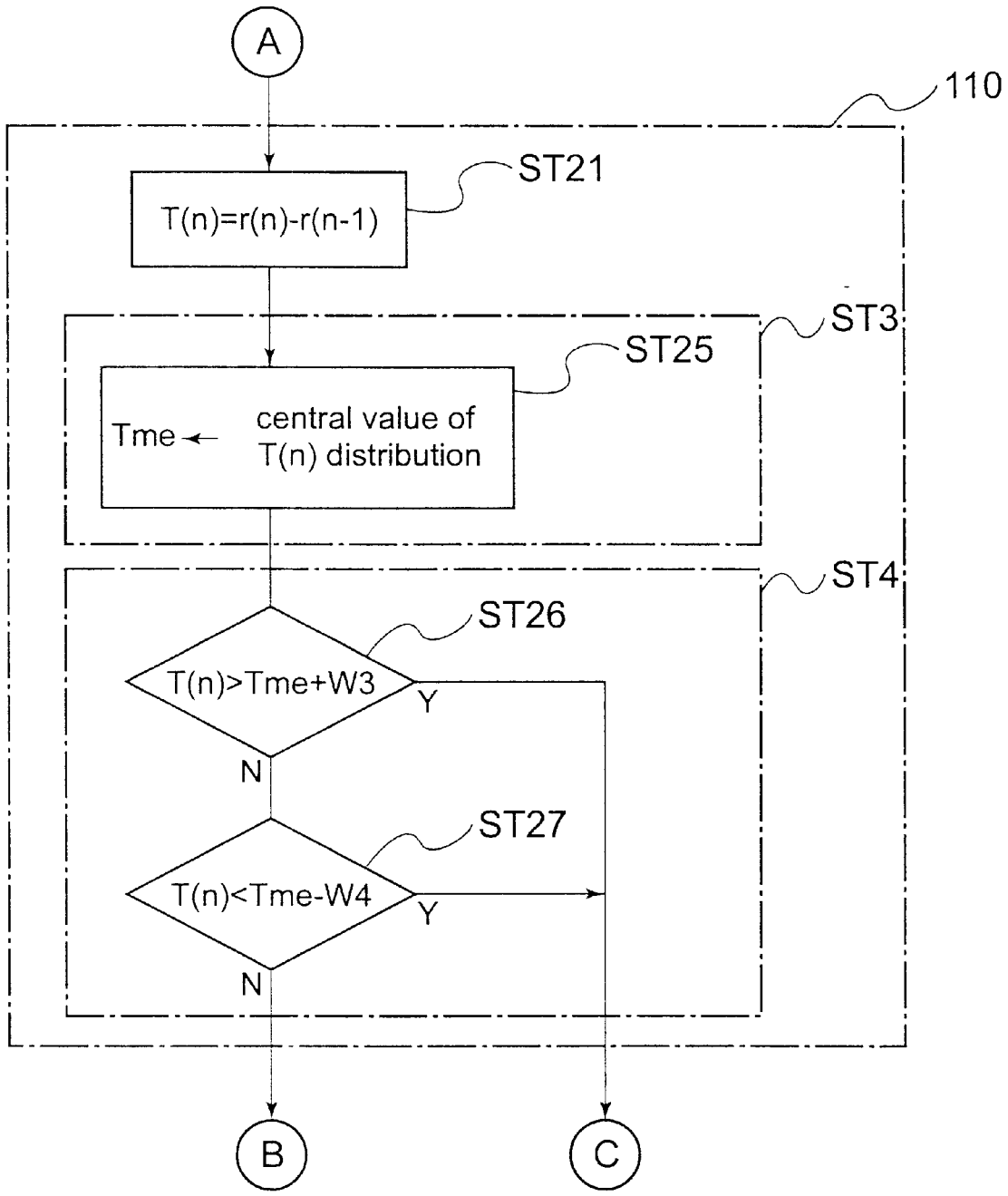
FIG. 12 is a flow chart illustrating a determination processing which differs from the determination processing shown in FIG. 7.

Furthermore, the process 110 described in FIG. 7 for determining whether or not a reset is intentional may not be so limited. For example, as shown in FIG. 12, in step ST21, the nearest reset time interval T(n) is calculated from obtained reset time r(n) and the previous reset time r(n−1). Next, in step ST25, out of past reset time intervals T(n) and the nearest reset time interval T(n), only such reset time intervals T(n) as are not in excess of several hours are extracted to obtain their distribution to calculate the median Tme of such a distribution. Then, the median of Tme may be set as a value for determination as to whether or not a reset is intentional.

Next, in step 26 and step 27, it is possible to determine whether or not a reset is intentional by determining whether or not the nearest reset time interval T(n) falls within the predetermined range in comparison with the determination value of Tme. In this example, in step ST26, whether or not the nearest reset time interval T(n) is larger than (Tme+W3) is determined. In step ST26, if it is not T(n)>(Tme+W3), the processing moves on to step ST27 to determine whether or not the nearest reset time interval T(n) is smaller than (Tme−W4). In step ST27, if it is not T(n)<(Tme−W4), the reset is determined to not be intentional, while if conditions of step 26 and step 27 are satisfied, then the reset is determined to be intentional.

As stated above, by setting a range for determination of an intentional reset signal by extracting such reset time intervals which are not longer than several hours out of past reset time intervals and the nearest reset time interval, it is possible to determine a reset signal as not being intentional in such cases where the same process is repeated routinely using an application, for example, processing of printing receipts that is repeated in intervals of several minutes or several tens of minutes with reset signals being supplied from the application each time. As the environment in which a printer is installed is reflected in the determination standards from experience, it is possible to achieve both saving of ink and higher reliability by accurately determining whether it is effective or not.

Second Embodiment

Figure 13:
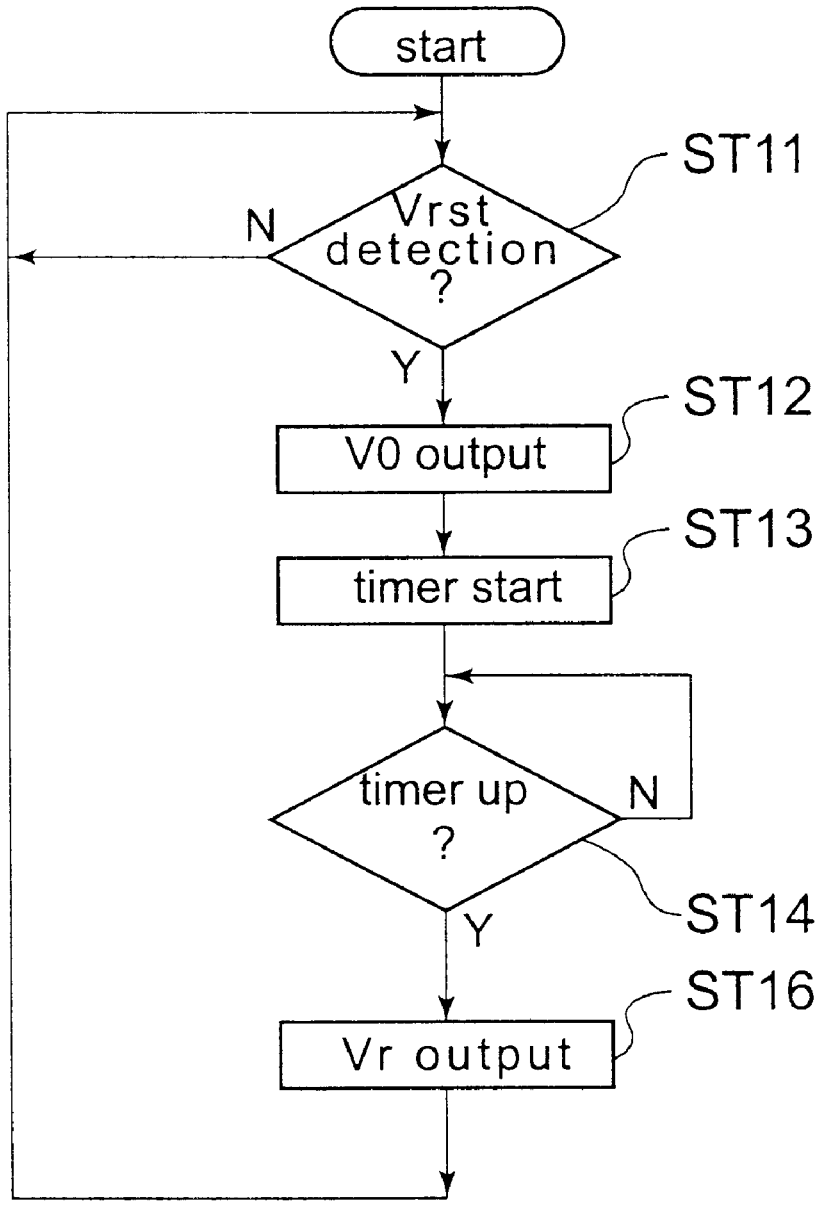
FIG. 13 is a flow chart illustrating an example of a reset signal processing of a printer according to a second embodiment of the present invention.

FIG. 13 is a flow chart for reset signal processing of a printer of another embodiment of the present invention. Description of the hardware construction of this example is omitted as it is the same as that of the first embodiment above (FIG. 4) except that the disable signal Vd is not output.

As shown in the figure, in step ST11, an external reset signal V0 is output if the reset detector 71 detects the reset signal Vrst (ST12). Upon receipt of the signal, the reset delay timer 72 is activated (ST13). After passage of a predetermined length of time, the reset delay timer 72 outputs the delayed reset signal V1 (ST14). Upon receipt thereof, the reset signal generator 73 outputs an internal reset signal Vr to the CPU 61 (ST16).

Figure 14:
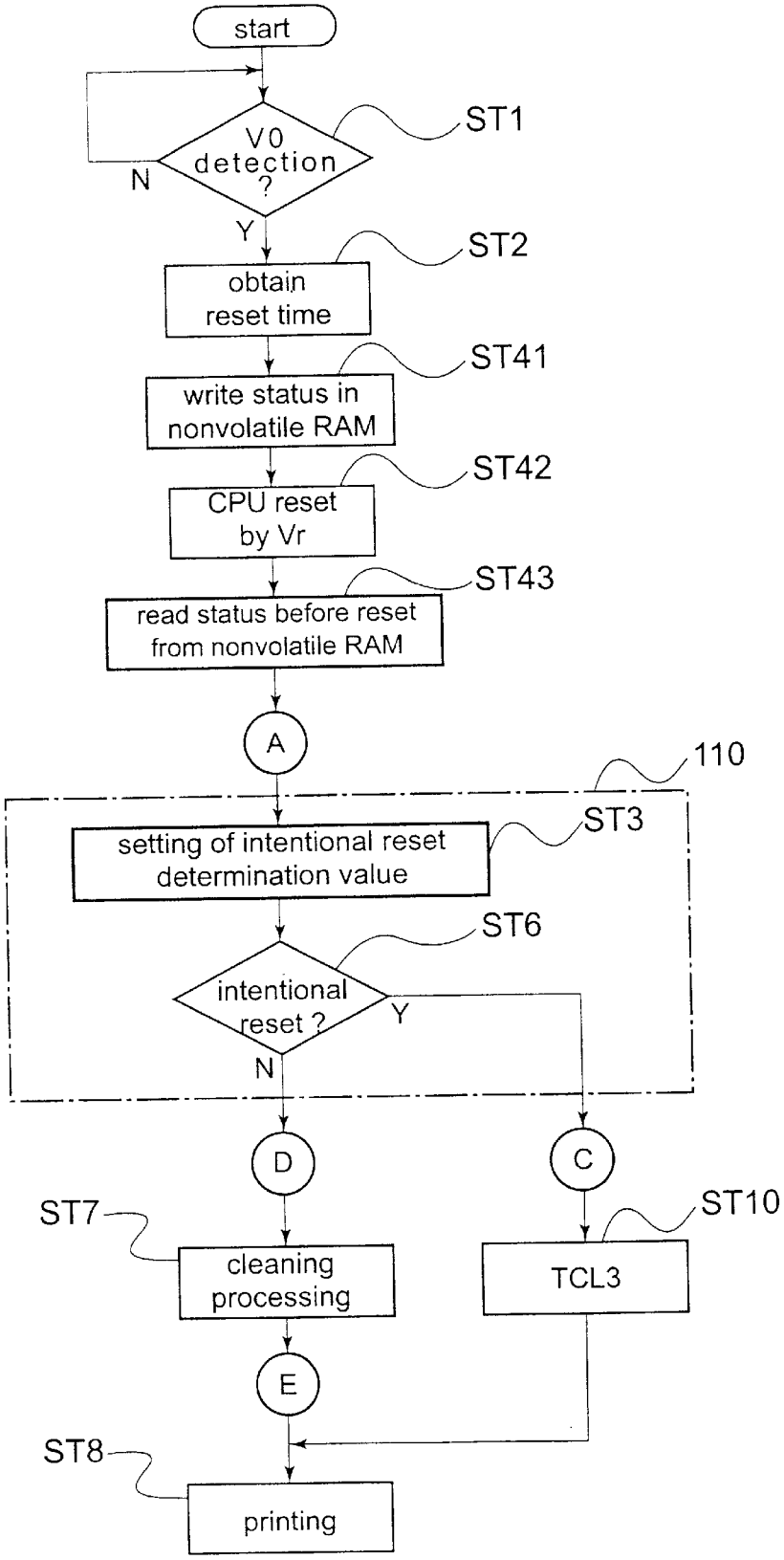
FIG. 14 is a flow chart illustrating the control operation of a printer according to the second embodiment of the present invention.

In FIG. 14, a method of cleaning processing of the printer of the present example is shown. Similarly to the printer of the first embodiment, in step ST1, if the CPU 61 detects the external reset signal V0 from the reset detector 71, in Step ST2 the current time is read in from the RTC 63 as a reset time r(n). Next, in step ST41, printer 1 status information including the reset time r(n) obtained from the RTC 63 is written into the nonvolatile RAM 62. Then, in step ST42, the internal reset signal Vr is output to forcibly reset the CPU 61.

Next, in step ST43, the forcibly reset CPU 61 reads out the printer 1 status information written into the nonvolatile RAM 62. Based on this information, like in the case of the first embodiment, a process 110 is conducted to determine whether or not the reset is intentional. If it is determined to be intentional, the process moves to step ST10 to conduct an initialization level cleaning TCL3; and if it is determined to not be intentional, the procedure proceeds to step ST7 to conduct a cleaning processing at an appropriate level based on the information of the nonvolatile RAM 62. After completion of the cleaning, printing starts in step ST8.

Figure 15:
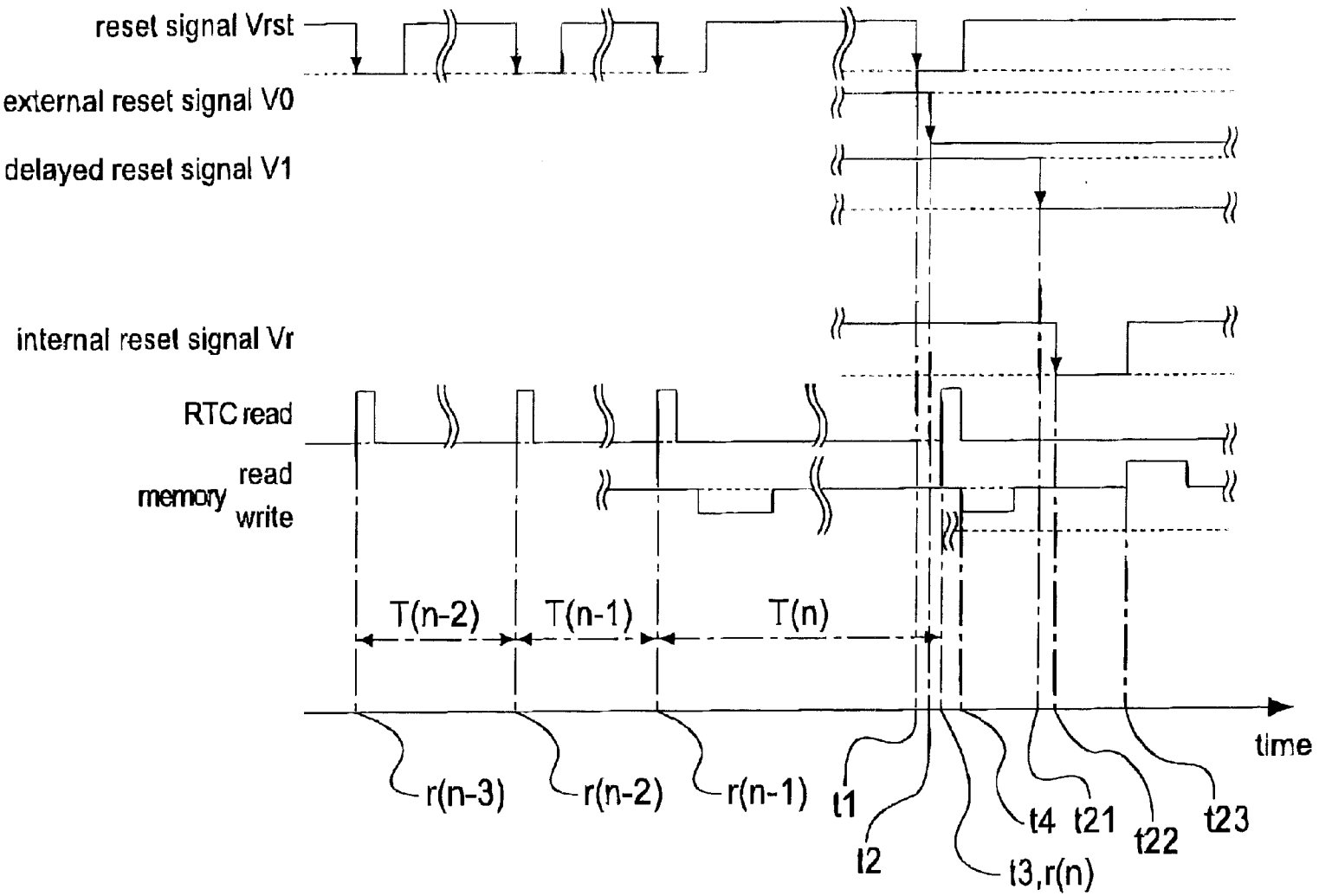
FIG. 15 is a time chart of various signals according to the second embodiment of the present invention.

FIG. 15 shows a time chart of various signals in the printer of this example. In the figure, at time t1, if the reset detector 71 receives the reset signal Vrst, at time t2 or the next timing, an external reset signal V0 is output from the reset detector 71 to the CPU 61 and the reset delay timer 72. Upon receipt of the external reset signal V0, the CPU 61 read in time t3 as a reset time r(n), and at time t4 it stores status information of printer 1, including the reset time t3, into the nonvolatile RAM 62.

If, at time t21, the delayed reset signal V1 from the reset delay timer 72 to the reset signal generator 73 changes from a high level to a low level, at time t22 or the next timing, the internal reset signal Vr is output from the reset signal generator 73.

In the printer of this example, as shown above, the CPU 61 is reset by means of hardware, after the status information of printer such as the reset time r(n), etc., is written into the nonvolatile RAM 62 when it recognizes the external reset signal V0. Information in the nonvolatile RAM 62 is obtained after reset to determine whether or not the reset signal Vrst is intentional based on the reset time intervals obtained from a plurality of past reset signals r(n). By writing information once into the nonvolatile RAM 62 in the previous step before the CPU 61 is reset by hardware, and by reading it out after the reset to determine whether or not the reset is intentional, the system is always initialized to enhance system reliability. Furthermore, as information before the reset is available from the nonvolatile RAM 62, it is possible to minimize ink consumption by always conducting an appropriate processing level of cleaning.

In the printer of the present example, similar to the printer of the first embodiment, determination is conducted based on a plurality of past reset time intervals T as to whether or not a reset signal Vrst is intentional, and furthermore, the range for determination is adjusted from time to time so as to be in an appropriate range. Accordingly, it is possible to conduct an appropriate determination corresponding to the environment in which the printer is utilized and to accurately determine which reset signals are not intentional. Also, it is possible to maintain reliability of printing, while minimizing ink consumption as an appropriate cleaning level is selected based on the status information of the printer 1.

In the above embodiments of the present invention, the nonvolatile RAM 62 is mentioned as an example of a memory device, but it is not so limited, and a hard disc, etc., may be used. Also, a DIP switch is mentioned as an example of a means for selecting dummy cleaning processing, but it is not so limited and may be another form of selecting means, for example, selecting in response to a control command from the host apparatus. Also, the reset time interval is determined by obtaining the current time from RTC63 but the current time is not necessarily required, and it may be sufficient to be able to find the length of time which has passed from the previous reset. Furthermore, it may be that a reset time interval is obtained by restarting a time measuring devise such as an RTC, etc., by a control device every time a reset is conducted.

As described above, in the printing apparatus and the control method thereof, determination of whether or not the reset signal from outside is intentional is performed based on a plurality of past reset time intervals, and furthermore, the standard value for the determination is adjusted from time to time so as to maintain it at an appropriate value. Accordingly, it is possible to be appropriately determined, depending on the environment in which a printing apparatus is used. Also, an appropriate level of cleaning processing is selected based on the status information of the printing apparatus, and it is possible to maintain reliability of printing while minimizing ink consumption.

What is claimed is:

1. A printing apparatus comprising:

time measuring means for measuring time intervals between reset signals received from a host device;

memory means for storing the time intervals measured by said time measuring means;

control means for controlling operation of said printing apparatus including writing to and reading from said memory means; and reset signal processing means for providing said control means with an external reset signal indicating receipt of a current one of the reset signals from said host device, said control means setting a range based on the time intervals stored in said memory means for determining whether a nearest one of the time intervals falls, corresponding to the current one of the reset signals, within the range.

2. The printing apparatus as claimed in claim 1, further comprising:

an ink jet head, and cleaning means for cleaning said ink jet head;

wherein said control means includes a cleaning control for operating said cleaning means at a plurality of processing levels each having a respective ink consumption quantity, and wherein said control means controls said cleaning means to perform an initialization level cleaning having an ink consumption at a predetermined quantity when said control means determines that the nearest one of the time intervals falls within the range.

3. The printing apparatus as claimed in claim 2, wherein said memory means stores status information of said printing apparatus, and said control means selects one of the plurality of said cleaning processing levels based on the status information to have said cleaning means perform when said control means determines that the nearest one of the time intervals is not within the range.

4. The printing apparatus as claimed in claim 1, wherein said reset signal processing means sends the external reset signal to said control means and sends an internal reset signal for initializing said control means to said control means having a predetermined time delay from the external reset signal, and said control means sends a suppressing signal to said reset signal processing means for suppressing the internal reset signal when the current one of the time intervals is determined not to be within the range.

5. The printing apparatus as claimed in claim 1, wherein said reset signal processing means sends the external reset signal to said control means and sends an internal reset signal for initializing said control means to said control means having a predetermined time delay from the external reset signal, and said control means stores at least the time interval in said memory means after receiving the external reset signal and before receiving said internal reset signal and sets said range based on the time intervals stored in said memory means after the internal reset signal is sent and initialization is conducted and determines whether the current one of the time intervals falls within the range.

6. The printing apparatus as claimed in claim 1, wherein said time measuring means measures a current time, and wherein said control means stores the current time in said memory means when said reset signal is detected as a reset time for determining the time interval from said reset time to set the range.

7. The printing apparatus as claimed in claim 1, wherein said control means determines an average value of the time intervals which are within a predetermined time length out of previous ones of the time intervals for setting said range based on the average value.

8. The printing apparatus as claimed in claim 7, wherein the predetermined time length comprises a time length within a range of at least one second to at least one minute.

9. The printing apparatus as claimed in claim 1, wherein said control means determines a median of a distribution of the time intervals which are within a predetermined time length out of previous ones of the time intervals and sets the range based on said median.

10. The printing apparatus as claimed in claim 9, wherein the predetermined time length is a time length of more than one minute.

11. A method for controlling a printing apparatus having a memory for storing status information of the printing apparatus, comprising the steps of:

(a) receiving data and control signals including reset signals from a host device;

(b) measuring time intervals between said reset signals received in step (a);

(c) storing the time intervals measured in step (b) into the memory;

(d) generating an external reset signal which indicates receipt of one of the reset signals received in step (a); and (e) setting a range based on the time intervals stored in step (c) to determine whether a current one of the time intervals falls within the range.

12. The method for controlling a printing apparatus as claimed in claim 11, further comprising the steps of:

(f) cleaning an ink jet head; and (g) selecting initialization level cleaning in step (f) having an ink consumption of a predetermined quantity when the current one of the time intervals is determined to be within said range in step (e).

13. The method for controlling a printing apparatus as claimed in claim 12, wherein step (c) further comprises storing status information of the printing apparatus, and wherein step (f) further comprises selecting and performing one of a plurality of cleaning processing levels based on the status information when the current one of the time intervals is determined not to be within the range in step (e).

14. The method for controlling a printing apparatus as claimed in claim 11, wherein step (d) further comprises the steps of:

generating an internal reset signal for initializing the printing apparatus with a delay of a predetermined time length from the external reset signal, and generating a suppressing signal to suppress the internal reset signal when the current one of the time intervals is determined not to be within the range in step (e).

15. The method for controlling a printing apparatus as claimed in claim 11, wherein step (d) further comprises the step of:

(d-1) generating an internal reset signal for initializing the printing apparatus with a delay of a predetermined time length from the external reset signal, wherein step (c) further comprises the step of storing at least the current one of the time intervals into the memory after receiving the external reset signal and before receiving the internal reset signal, and wherein step (e) further comprises the steps of:

setting the range based on the time intervals stored in the memory after step (d-1), and determining whether the current one of the time intervals is within the range.

16. The method for controlling a printing apparatus as claimed in claim 11, wherein step (b) further comprises the step of measuring a current time, wherein step (c) further comprises the step of storing the current time when the reset signal is detected into the memory as a reset time, and wherein step (e) further comprises the step of seeking the current one of the intervals from the reset time to set the range.

17. The method for controlling a printing apparatus as claimed in claim 11, wherein step (e) further comprises the step of seeking an average value of the time intervals which are within a predetermined time length out of a previous one of the time intervals for setting the range based on the average value.

18. The method for controlling a printing apparatus as claimed in claim 17, wherein said predetermined time length is a time length within a range of more than one second to more than one minute.

19. The method for controlling a printing apparatus as claimed in claim 11, wherein step (e) further comprises the step of seeking a median of a distribution of the time intervals which are within a predetermined time length out of a previous one of the time intervals and setting the range based on the median.

20. The method for controlling a printing apparatus as claimed in claim 19, wherein the predetermined time length is a time length of more than one minute.

21. A medium readable by a machine embodying a program of instructions for execution by the machine to perform a method for controlling a printing apparatus having a memory for storing status information of the printing apparatus, the method comprising the steps of:

(a) receiving data and control signals including reset signals from a host device;

(b) measuring time intervals between said reset signals received in step (a);

(c) storing the time intervals measured in step (b) into the memory;

(d) generating an external reset signal which indicates receipt of one of the reset signals received in step (a); and (e) setting a range based on the time intervals stored in step (c) to determine whether a current one of the time intervals falls within the range.

22. The medium as claimed in claim 21, further comprising the steps of:

(f) cleaning an ink jet head; and (g) selecting initialization level cleaning in step (f) having an ink consumption of a predetermined quantity when the current one of the time intervals is determined to be within said range in step (e).

23. The medium as claimed in claim 22, wherein step (c) further comprises storing status information of the printing apparatus, and wherein step (f) further comprises selecting and performing one of a plurality of cleaning processing levels based on the status information when the current one of the time intervals is determined not to be within the range in step (e).

24. The medium as claimed in claim 21, wherein step (d) further comprises the steps of:

generating an internal reset signal for initializing the printing apparatus with a delay of a predetermined time length from the external reset signal, and generating a suppressing signal to suppress the internal reset signal when the current one of the time intervals is determined not to be within the range in step (e).

25. The medium as claimed in claim 21, wherein step (d) further comprises the step of:

(d-1) generating an internal reset signal for initializing the printing apparatus with a delay of a predetermined time length from the external reset signal, wherein step (c) further comprises the step of storing at least the current one of the time intervals into the memory after receiving the external reset signal and before receiving the internal reset signal, and wherein step (e) further comprises the steps of:

setting the range based on the time intervals stored in the memory after step (d-1), and determining whether the current one of the time intervals is within the range.

26. The medium as claimed in claim 21, wherein step (b) further comprises the step of measuring a current time, wherein step (c) further comprises the step of storing the current time when the reset signal is detected into the memory as a reset time, and wherein step (e) further comprises the step of seeking the current one of the intervals from the reset time to set the range.

27. The medium as claimed in claim 21, wherein step (e) further comprises the step of seeking an average value of the time intervals which are within a predetermined time length out of a previous one of the time intervals for setting the range based on the average value.

28. The medium as claimed in claim 27, wherein said predetermined time length is a time length within a range of more than one second to more than one minute.

29. The medium as claimed in claim 21, wherein step (e) further comprises the step of seeking a median of a distribution of the time intervals which are within a predetermined time length out of a previous one of the time intervals and setting the range based on the median.

30. The medium as claimed in claim 29, wherein the predetermined time length is a time length of more than one minute.

31. A printing apparatus comprising:

a timer to measure time intervals between reset signals received from a host device;

a memory to store the time intervals measured by said timer;

a controller to control operation of said printing apparatus including writing to and reading from said memory; and a reset signal processor to provide said controller with an external reset signal indicating receipt of a current one of the reset signals from said host device, said controller setting a range based on the time intervals stored in said memory for determining whether a nearest one of the time intervals falls, corresponding to the current one of the reset signals, within the range.

32. The printing apparatus as claimed in claim 31, further comprising:

an ink jet head, and a cleaner to clean said ink jet head;

wherein said controller includes a cleaning control for operating said cleaner at a plurality of processing levels each having a respective ink consumption quantity, and wherein said controller controls said cleaner to perform an initialization level cleaning having an ink consumption at a predetermined quantity when said controller determines that the nearest one of the time intervals falls within the range.

33. The printing apparatus as claimed in claim 32, wherein said memory stores status information of said printing apparatus, and said controller selects one of the plurality of said cleaning processing levels based on the status information to have said cleaner perform when said controller determines that the nearest one of the time intervals is not within the range.

34. The printing apparatus as claimed in claim 31, wherein said reset signal processor sends the external reset signal to said controller and sends an internal reset signal for initializing said controller to said controller having a predetermined time delay from the external reset signal, and said controller sends a suppressing signal to said reset signal processor for suppressing the internal reset signal when the current one of the time intervals is determined not to be within the range.

35. The printing apparatus as claimed in claim 31, wherein said reset signal processor sends the external reset signal to said controller and sends an internal reset signal for initializing said controller to said controller having a predetermined time delay from the external reset signal, and said controller stores at least the time interval in said memory after receiving the external reset signal and before receiving said internal reset signal and sets said range based on the time intervals stored in said memory after the internal reset signal is sent and initialization is conducted and determines whether the current one of the time intervals falls within the range.

36. The printing apparatus as claimed in claim 31, wherein said timer measures a current time, and wherein said controller stores the current time in said memory when said reset signal is detected as a reset time for determining the time interval from said reset time to set range.

37. The printing apparatus as claimed in claim 31, wherein said controller determines an average value of the time intervals which is within a predetermined time length out of previous ones of the time intervals for setting said range based on the average value.

38. The printing apparatus as claimed in claim 37, wherein the predetermined time length comprises a time length within a range of at least one second to at least one minute.

39. The printing apparatus as claimed in claim 31, wherein said controller determines a median of a distribution of the time intervals which are within a predetermined time length out of previous ones of the time intervals and sets the range based on said median.

40. The printing apparatus as claimed in claim 39, wherein the predetermined time length is a time length of more than one minute.

* * * * *